US006363550B1

(12) United States Patent
Wang

(10) Patent No.: US 6,363,550 B1
(45) Date of Patent: Apr. 2, 2002

(54) JOINT FOR A COLLAPSIBLE RAIL OF A PLAYPEN

(76) Inventor: Kun Wang, NO.56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/418,680

(22) Filed: Oct. 14, 1999

(51) Int. Cl.[7] ..... A47D 7/00
(52) U.S. Cl. ..... 5/99.1; 5/93.1; 403/102
(58) Field of Search ..... 5/99.1, 98.2, 93.1; 403/100, 101, 102

(56) References Cited

U.S. PATENT DOCUMENTS 5,483,710 A * 1/1996 Chan ..... 5/99.1
5,611,634 A * 3/1997 Wang ..... 403/102
5,761,755 A * 6/1998 Huang ..... 5/99.1
5,906,013 A * 5/1999 Wang ..... 5/99.1
5,906,014 A * 5/1999 Zhuang ..... 5/99.1
5,978,987 A * 11/1999 Wang ..... 5/99.1
5,988,928 A * 11/1999 Cheng ..... 403/102
6,223,366 B1 * 5/2000 Cheng ..... 5/99.1
6,202,229 B1 * 3/2001 Cheng ..... 5/99.1

* cited by examiner

*Primary Examiner*—Lynne H. Browne
*Assistant Examiner*—James M. Hewitt

(57) ABSTRACT

A joint for collapsible rails of a playpen includes a joint pivoting the inner ends of a pair of identical parts of the rail. The parts each has a pair of retractable projection of a V-shaped spring plate releasibly engaged into an aligned thru hole of the joint for the enabling or unabling the rotations of the identical parts of the rail. A slide is disposed into the joint central the reduced ends of the V-shaped spring plate to permit the engagement and/or disengagement of the above projection with aligned thru hole in order to readily provide collapsing or flattening the playpen upon only one application of the slide.

8 Claims, 12 Drawing Sheets

JOINT FOR A COLLAPSIBLE RAIL OF A PLAYPEN

BACKGROUND OF THE INVENTION

The present invention relates to a baby playpen and more particularly to a joint for a collapsible rail of the playpen which facilitates safe collapse and precise positioning of the playpen.

A collapsible playpen can reduce the size of the playpen to allow for easier transport. A typical collapsible playpen 20 is shown in FIGS. 10 to 12, and comprises four collapsible rails 11 pivoted at four corner members 12. Each of the rails 11 includes two identical parts pivoted by a joint 10 which enables the rails 11 to be collapsed. The joint 10 has a hollow interior body of inverse U-shaped cross section, a notch in each end of the joint, a first aligned thru hole 29 below each notch and engageable with a second aligned through hole 14 in each part of the rail 11 so as to pivot the parts of the rail 11 thereon by pin 15, a V-shaped spring plate 3 inserted into the inner end of each part of the rail 11 and each including a pair of projections 31 on lateral sides engageable with a third aligned thru hole 13 adjacent the inner end of each part of the rail and the fourth aligned thru holes 22 of the hollow interior body, and a slide 4 slidably secured into the hollow interior body by a pin 25 and through another notch under the body. The slide 4 includes a V-shaped notch 41 having a pair of sloped surfaces 42 and an aligned oblong hole 43 for engaging the pin 25. A crown plate 5 abuts against the underside of the pin 25 and is biased by a spring 28. Since the V-shaped spring plate 3 has two ends engaged in the V-shaped notch 41, when the slide slides inward relative to the hollow interior body, the spring plate 3 is pressed by the sloped surfaces 42 of the notch 41 and contracts so that the pair of projections 31 disengage with the thru hole 22 to permit the one part of the rail 11 to be collapsible. Accordingly, it is ineffective to just collapse one part of the rail.

SUMMARY OF THE PRESENT INVENTION

The present invention has a principal object to provide a joint for a collapsible rail of a collapsible playpen which joint provides stability and facilitates collapsing of the rail by a single press on the slide in order to make it easier for the user to collapse the playpen.

The present invention will become more fully understood by reference to the following detailed description thereof when read in conjunction with the attached drawings.

DETAILED DESCRIPTION OF THE PREFERRED EMBODIMENT

Figure 1:
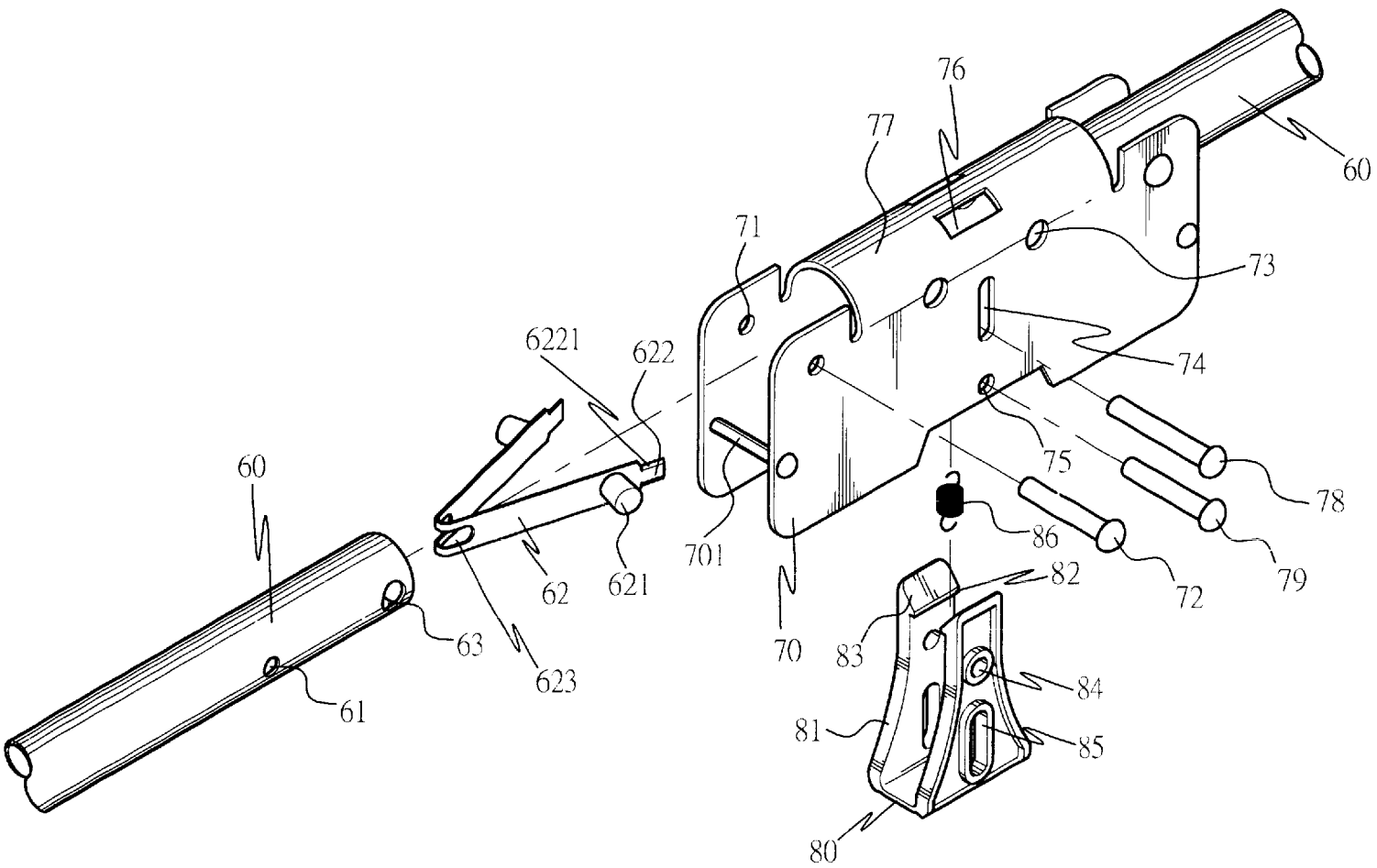
FIG. 1 is an exploded perspective view to show a preferred embodiment of the present invention.
Figure 2:
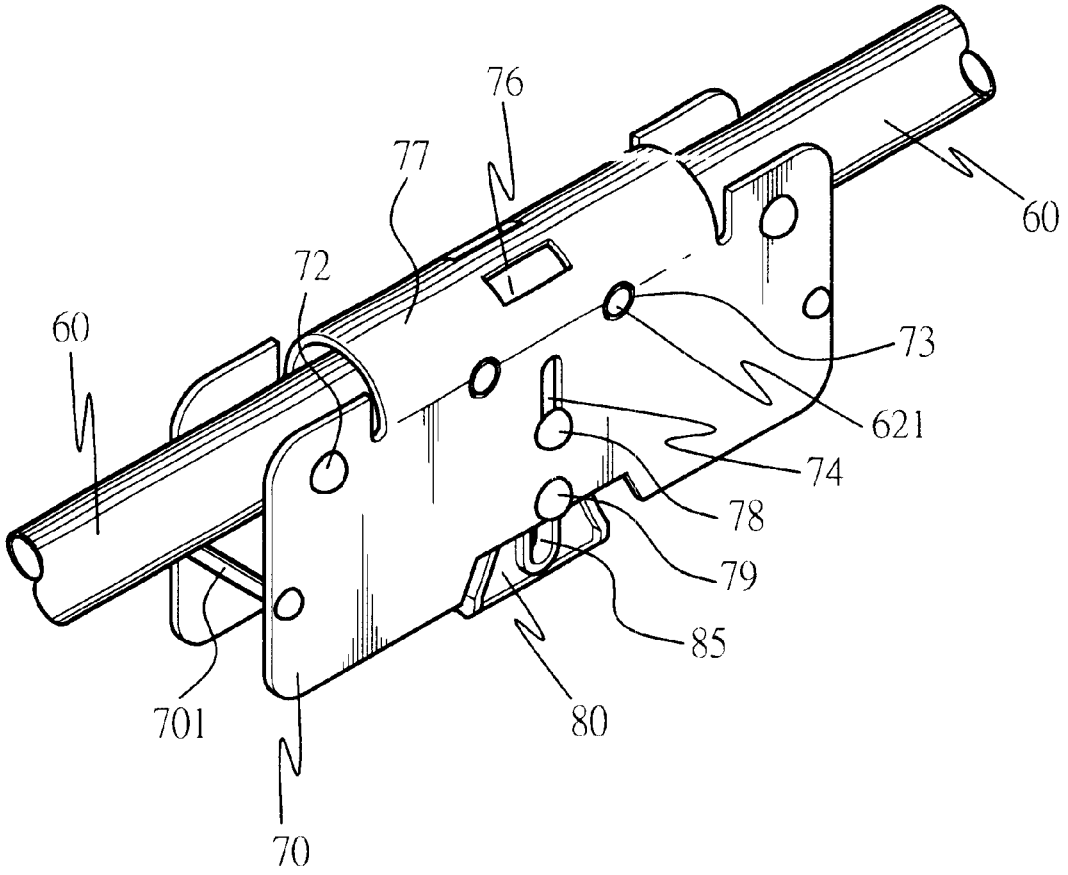
FIG. 2 is a perspective view to show an assemblage of FIG. 1.
Figure 3:
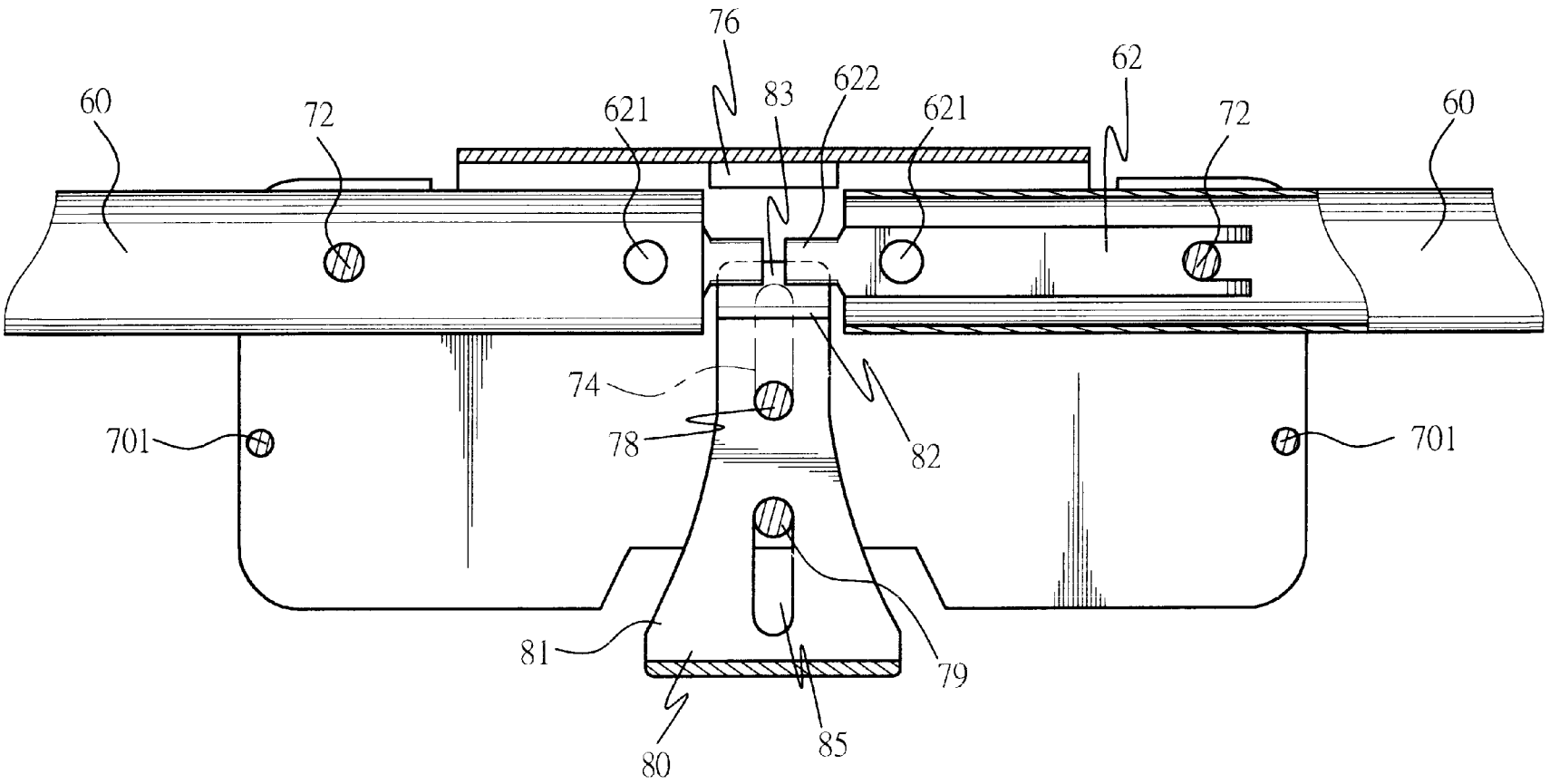
FIG. 3 is a plane view with partial sectional view of FIG. 2.
Figure 4:
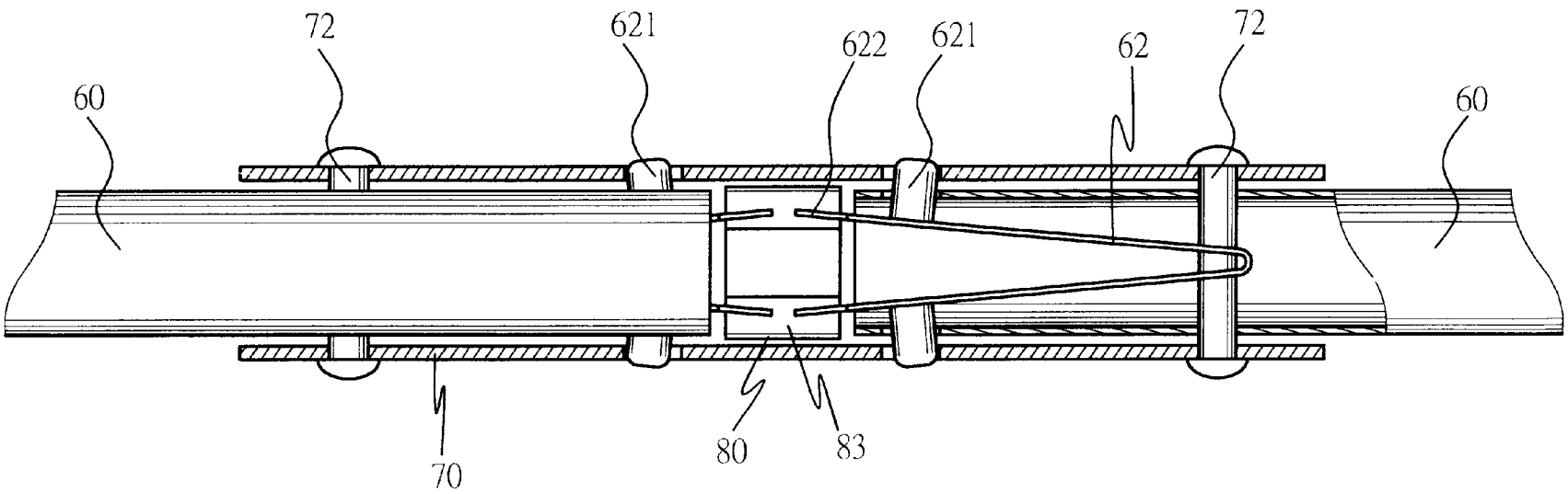
FIG. 4 is a top view with partial sectional view of FIG. 2.
Figure 5:
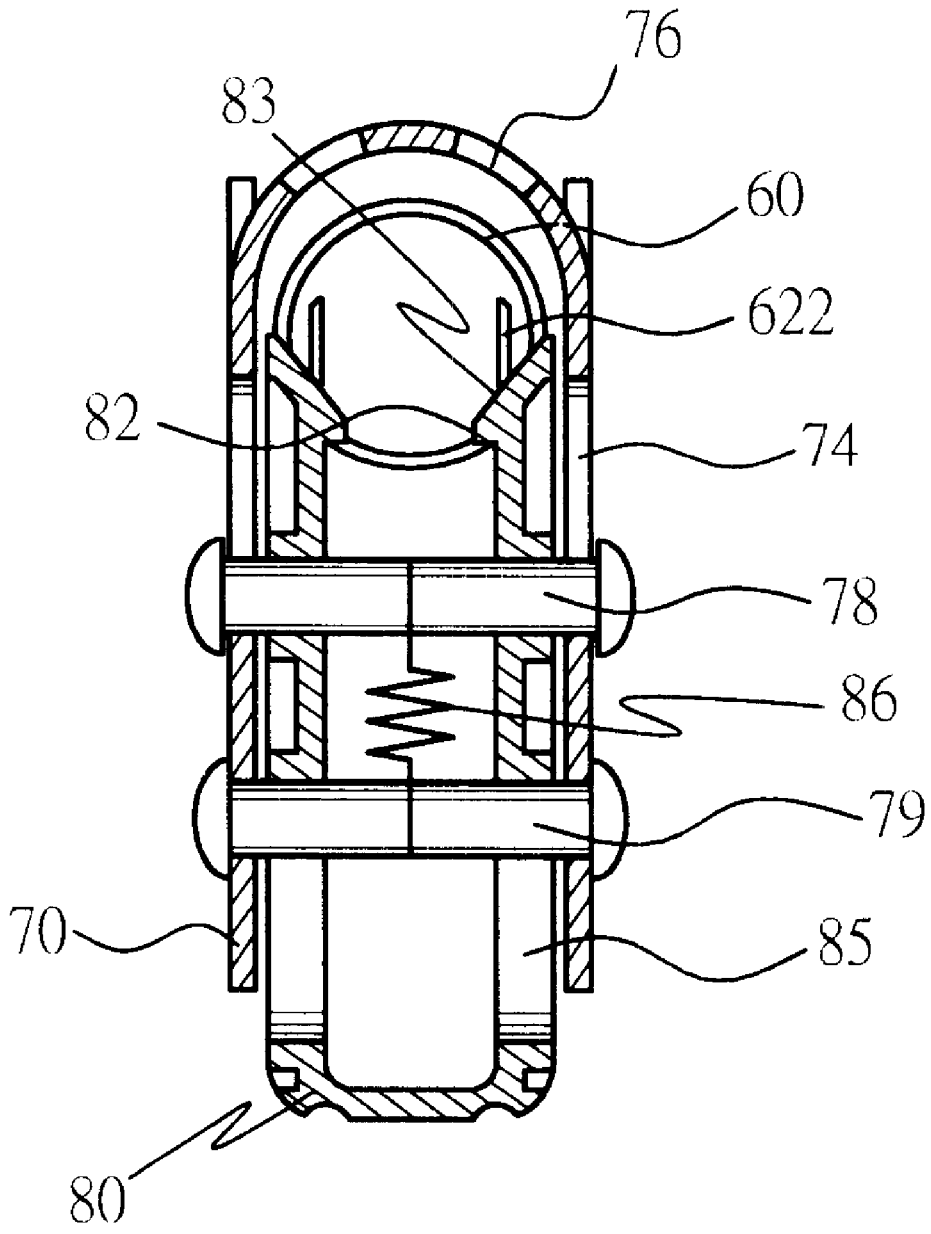
FIG. 5 is a cross-sectional view of FIG. 2.

With reference to FIGS. 1 to 9, a joint for a collapsible rail is pivoted to the inner ends of a pair of identical parts of one of four rails 60 of a playpen 50, each of the identical parts has an outer end which is pivoted to a corner member 51 on the top of the playpen.

The joint 70 comprises a hollow interior body of inverse U-shaped section, a pair of first notches in the top of the body adjacent two ends of the body, a pair of first aligned thru holes 71 below the first notches, a pair of positioning rods 701 secured beneath the thru holes 71 across the hollow interior body, a pair of second aligned thru holes 73 formed spaced apart in an upper center of the body, a first aligned oblong hole 74 vertically formed in the center of the body, a third aligned thru hole 75 beneath the oblong hole 74, a pair of rectangular openings 76 formed spaced apart in an arcuate portion 77 on the top of the body and a pair of second notches centrally formed in lower end of the body beneath the third thru hole 75.

A pair of identical parts of a rail 60 each has a tubular body, a fourth aligned thru hole 63 abutting the inner end and a fifth aligned thru hole 61 positioned in the proximity of the fourth aligned thru hole 63. A V-shaped spring plate 62 has a pair projections 621 respectively extended outward from two lateral sides adjacent two ends thereof, a reduced portion 622 at each of the two ends and each including a sloped upper surface 6221, and a third notch 623 in the peak of the V-shaped spring plate 62. A slide 80 has a U-shaped body, a pair of ax-shaped lateral plates 81 each including a hook 82 on inner side and a bevel surface 83 at the top end, a sixth aligned thru hole 84 in the upper portion engageable with the oblong hole 74 and a second aligned oblong hole 85 engageable with the third aligned thru hole 75 of the hollow interior body of the joint 70.

For assembly, first engage the V-shaped spring plate 62 into the inner end of each of the identical parts of the rail 60 until the projections 621 thrust out of the fourth aligned thru hole 63 and respectively insert the identical parts into two ends of the hollow interior body so that the projections 621 automatically snap up through the second aligned thru hole 73, then engage the first axial pins 72 into the aligned thru holes 71 and 61 to pivot the identical parts on the hollow interior body such that the third notches 623 of the V-shaped spring plates engage on the first axial pin 72 for preventing the V-shaped spring plate from becoming inclined relative to the parts of the rail 60 and the identical parts are horizontally connected with the hollow interior body with their undersides stopped against the positioning rods 701, and then insert the slide 80 into the hollow interior body from below the second notches and secure the slide 80 respectively by a second axial pin 78 through the first aligned oblong hole 74 and the sixth aligned thru hole 84 and a third axial pin 79 through the third aligned thru hole 75 and the second aligned oblong hole 85. Finally, use a coil spring 86 having hooks at two ends respectively hooking the second axial pins 78 and third axial pins 79 so that the slide 80 can be retracted automatically after pressing in under the resilience of the spring 86. Meanwhile, the reduced portions 622 of the V-shaped spring plate 62 engage within the bevel surface 83 on the top end of the two lateral plates 81 of the slide 80 (as shown in FIGS. 2, 3, 4 and 5).

Figure 6:
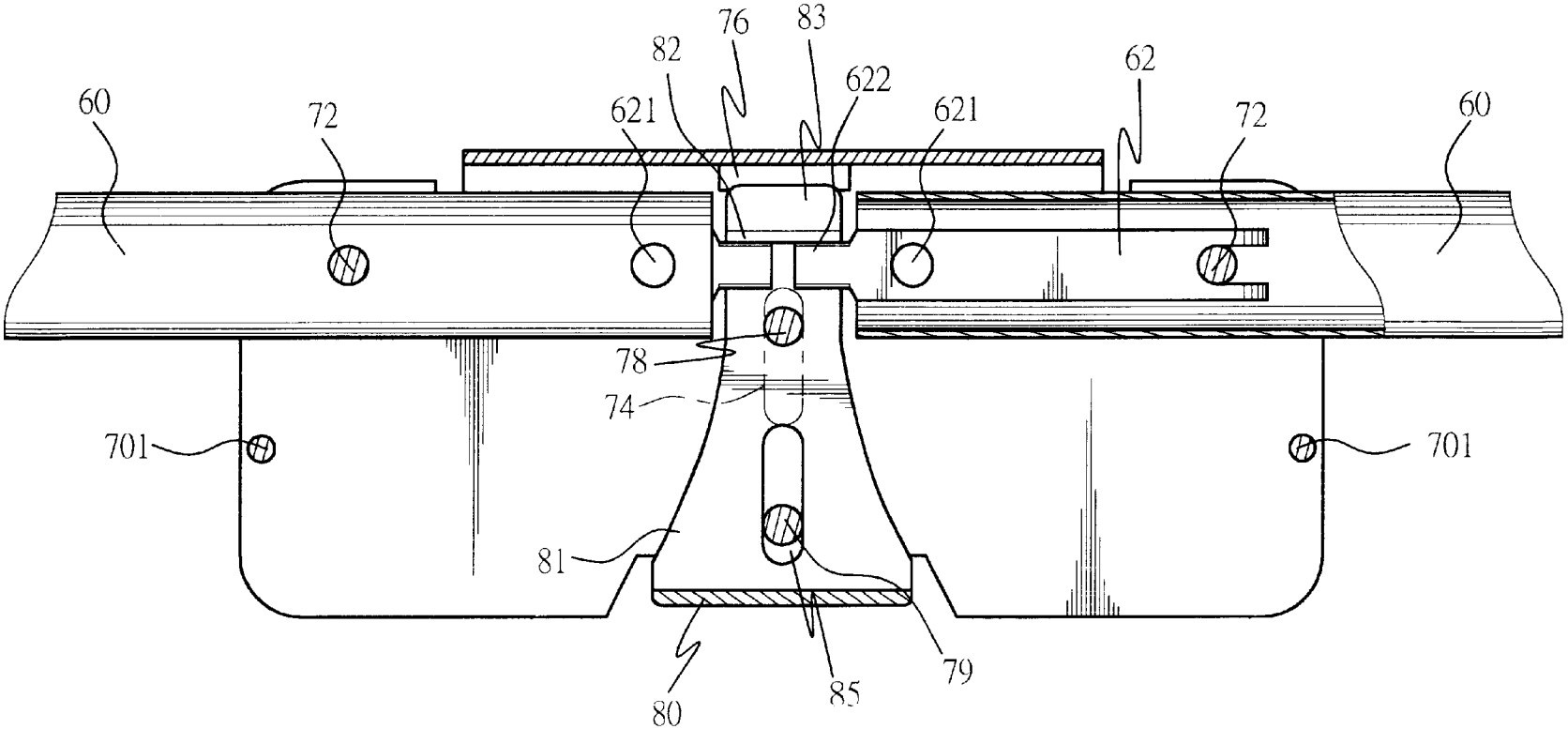
FIG. 6 is an elevational view of FIG. 2 when the slide is being pressed upward.
Figure 7:
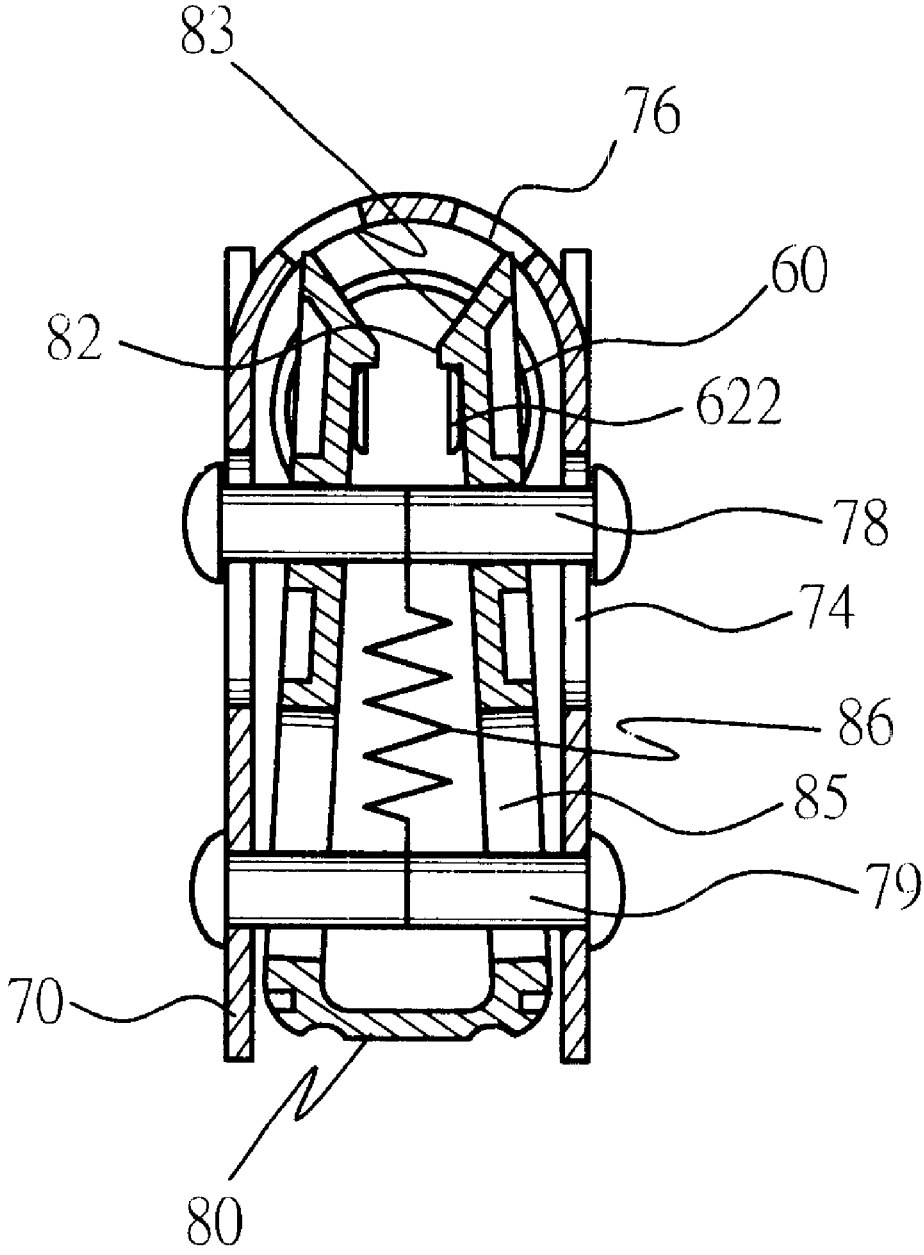
FIG. 7 is a cross-sectional of FIG. 6.
Figure 8:
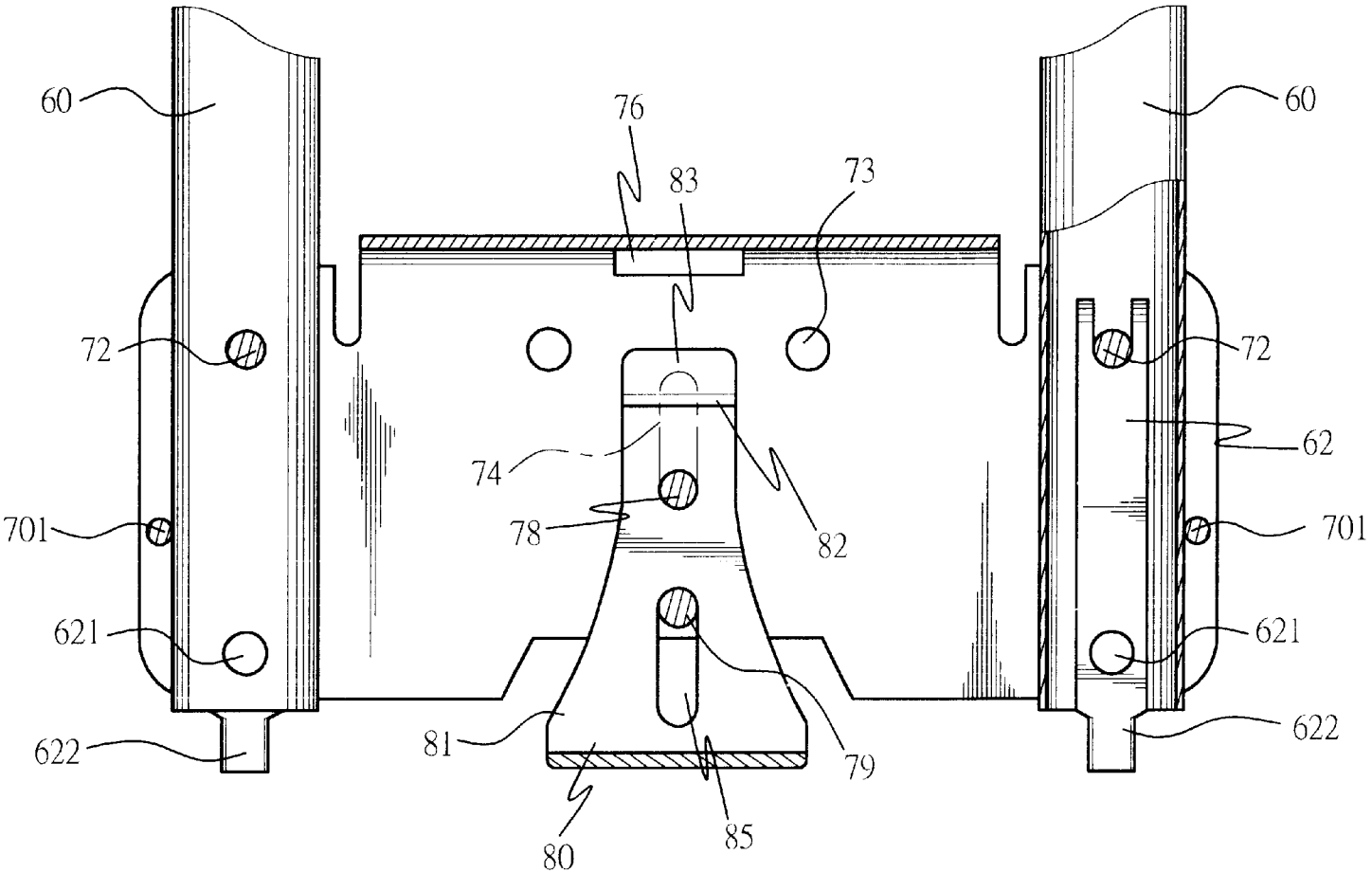
FIG. 8 is an elevational view to show that the parts of the rail are collapsed.
Figure 9:
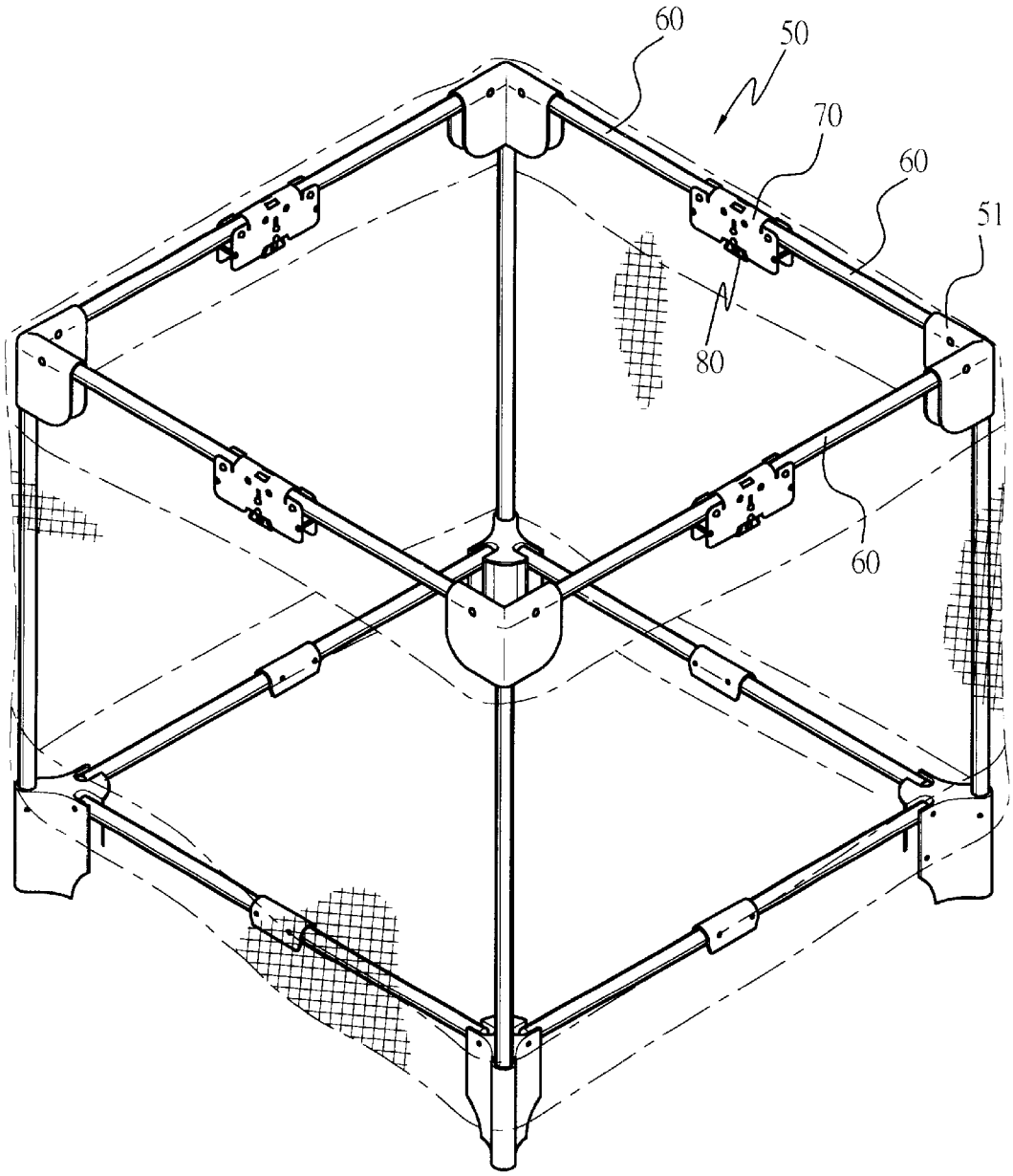
FIG. 9 is a perspective view to show a playpen of the present invention.
Figure 10:
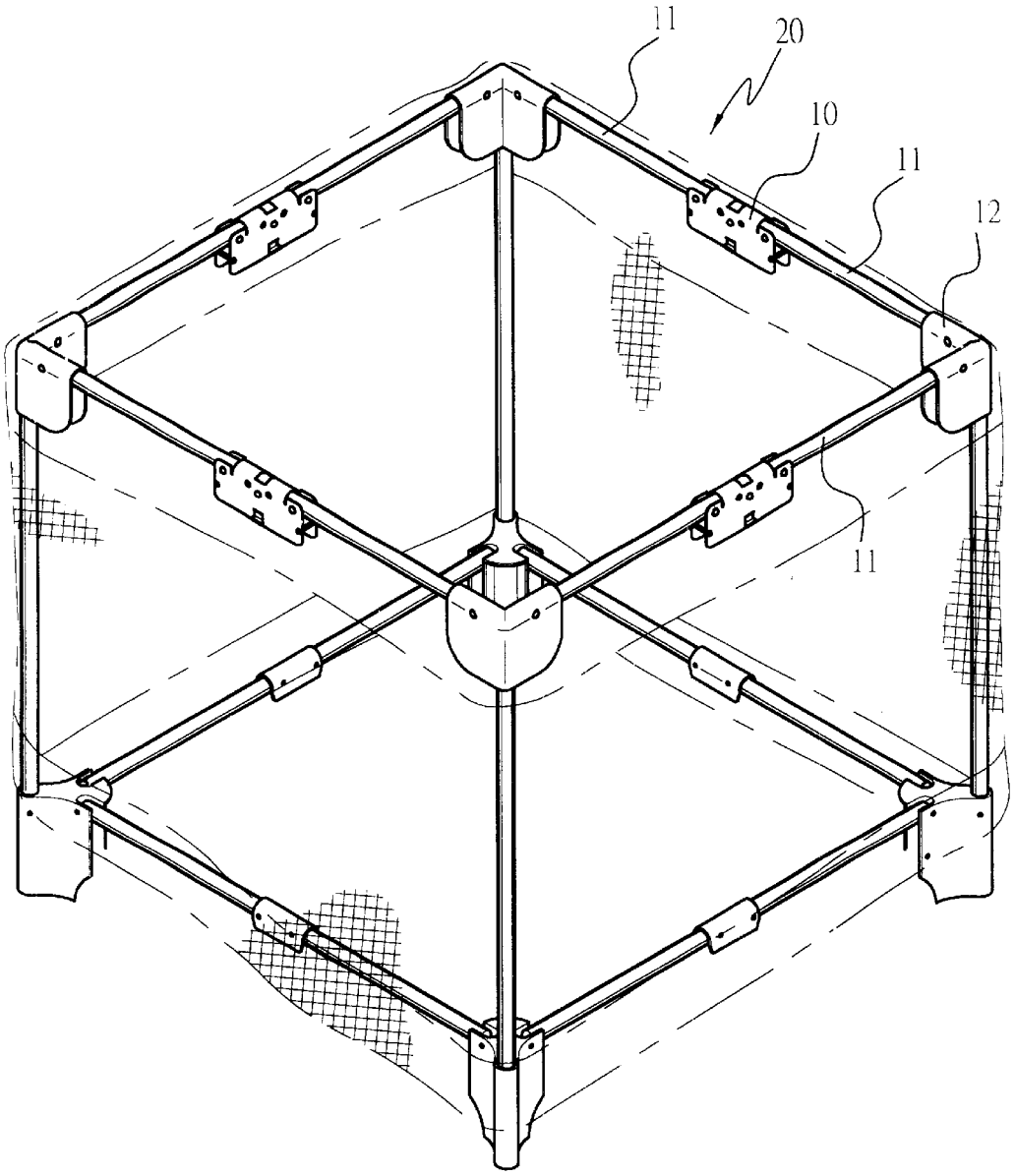
FIG.10 Prior Art
FIG. 10 is a perspective view of a playpen according to the prior art.
Figure 11:
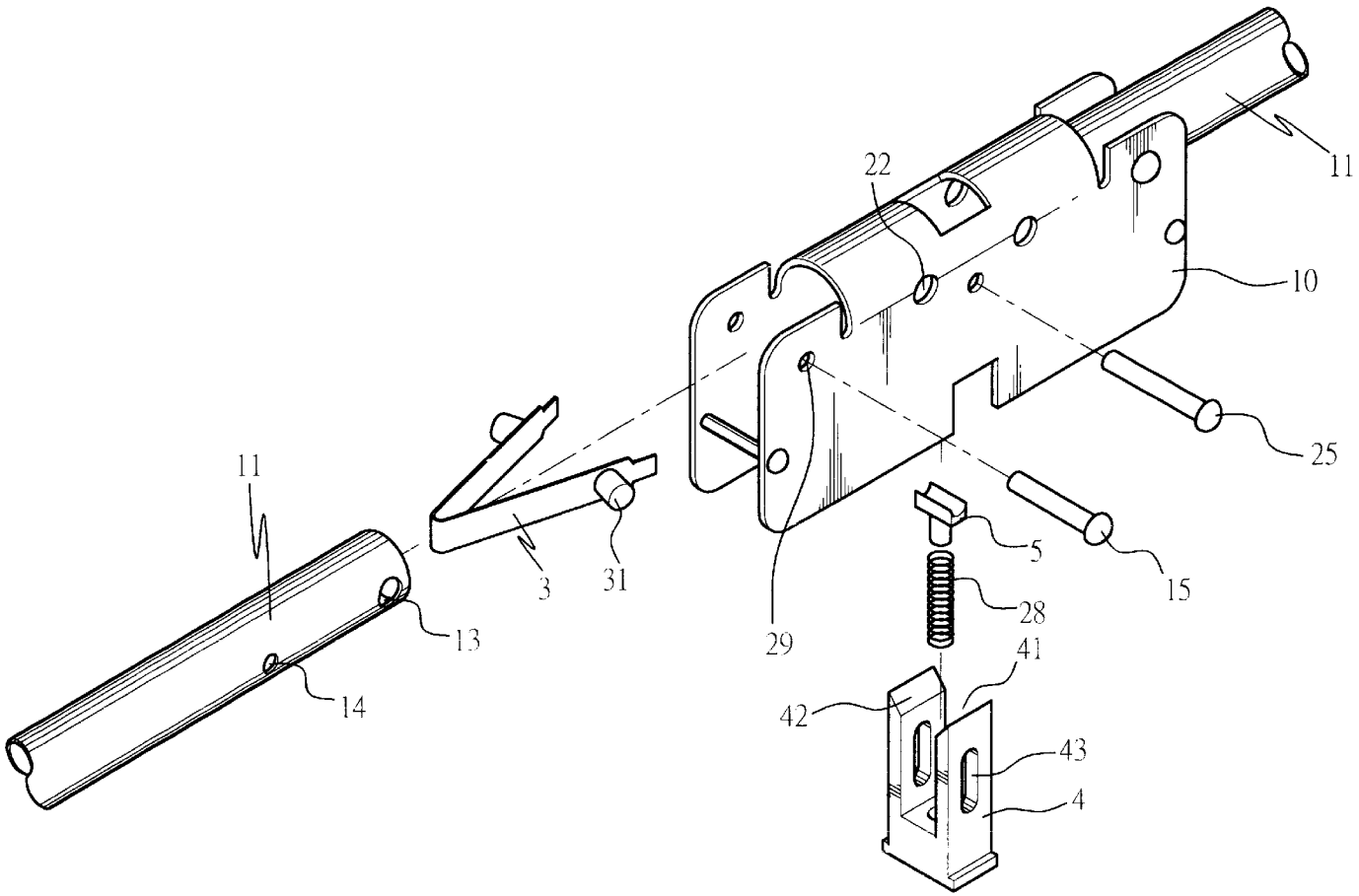
FIG. 11 Prior Art
FIG. 11 is an exploded perspective view of a collapsible joint according to the prior art.
Figure 12:
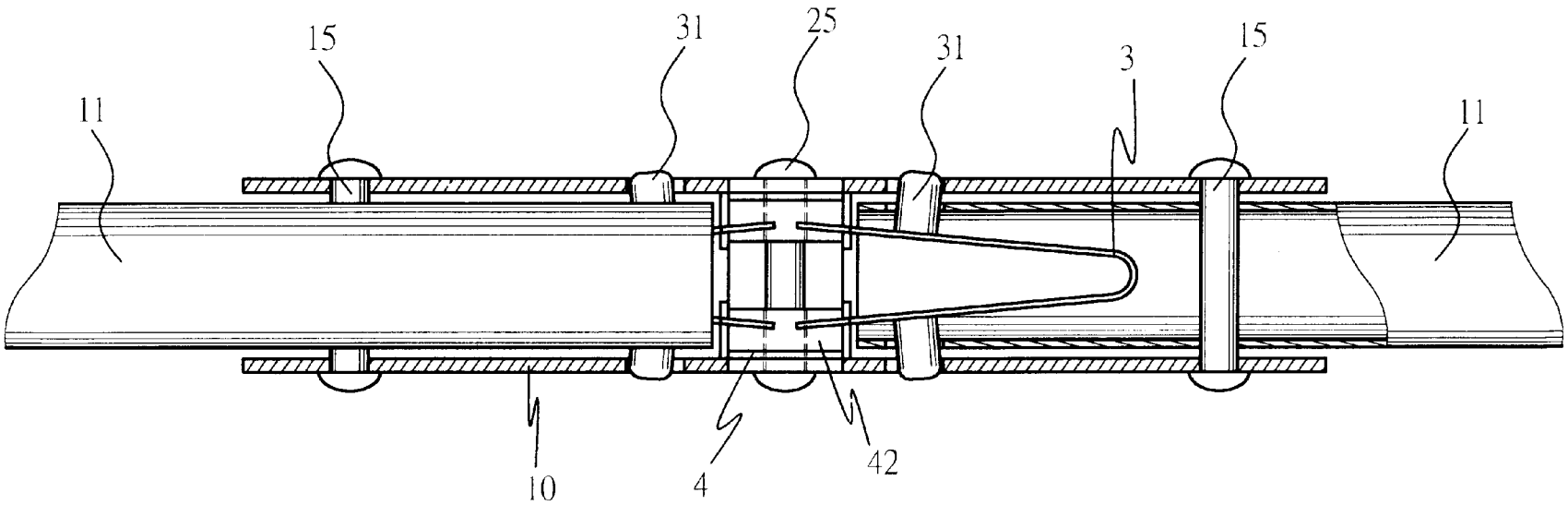
FIG. 12 Prior Art
FIG. 12 is a sectional view of an assemblage of FIG. 11.

The two identical parts of the rail 60 remain horizontal when the playpen 50 of the present invention is in its expanded, standing state. If one presses the slide 80 of each of the rails 60 once upward to have the tops of the lateral plates 81 thrusted out of the openings 76 of the hollow interior body, the span of the reduced portion 622 of each of the V-shaped spring plates 62 will become narrower because of the bevel surfaces 83 until the sloped upper surfaces 6221 of the reduced portions 622 come to rest under the hooks 82 so that the projections 621 of the V-shaped spring plate 62 are totally disengaged with the second aligned thru holes 73 of the joint 70 and the spring 86 is tensed up by the pins 78. Meantime, the identical parts of the rail become free to rotate upward on the pins 72 and the reduced portions 622 of the V-shaped spring plates 62 can easily disengage with the hooks 82 of the slide 80, therefore, the slide 80 automatically returns to its original position under the resilience of the spring 86 (as shown in FIGS. 6, 7 and 8). If one presses the joint 70 downward, one can readily collapse the playpen 50 of the present invention.

If one stands the playpen 50 up again, one can push the slide 80 upward, so that the reduced portions 622 of the V-shaped plate 62 can be easily passed through the hooks 82 of the slide 80 since the projections 621 are limited by the inner walls of the joint 70 to enable the span between the reduced portions 622 to be wide before the projections 621 engage into the second aligned thru holes 73 of the joint 70 and the identical ports of the rails 60 become horizontal.

Accordingly, the joint 70 for collapsible rail 60 of the present invention facilitates more convenient and effective collapse of a playpen in comparison with the prior art described the above.

The specification relating to the above embodiment should be construed as exemplary rather then as limitative of the present invention with many variations and modifications being readily attainable by a person of average skill in the art without departing from the spirit or scope thereof as defined by the appended claims and their legal equivalents.

I claim:

1. A joint assembly for a collapsible playpen, the assembly comprising:

a joint including a hollow body of inverse U-shaped section, a pair of first notches at a top of the body and adjacent each of two ends thereof, a pair of first aligned thru holes below the first notches respectively, a pair of positioning rods secured below the first aligned thru holes respectively, each extending transversely across the hollow body, a pair of second aligned thru holes formed spaced apart in an upper center of the hollow body, a first aligned oblong hole vertically formed in a center of the body below the second aligned thru holes, a third aligned thru hole in a center of the body below the first aligned oblong hole, a pair of second notches centrally formed in lower end of the body below the third aligned thru hole and a pair of rectangular openings centrally formed spaced a part in an arcuate portion on a top of the body between the first notches;

a pair of rods which comprise a rail of the playpen each including a tubular body, a first end pivoted to a respective corner member on top of the playpen and a second end having a fourth aligned thru hole adjacent the second end and a fifth aligned thru hole positioned in the proximity of the fourth aligned thru hole for pivoting the rods to the hollow body of the joint by a first axial pin extending through the first aligned thru holes of the body;

a pair of V-shaped spring plates inserted into the second end of each of the rods and each including a third notch at the peak of the 'V' for engaging the first axial pin, a pair of reduced ends each having a sloped surface and a pair of projections extending outward from outer surfaces of the respective plates and adjacent the reduced ends and for extending through of the fourth aligned thru holes and snapping up into the second aligned thru holes of the hollow body;

a slide including a U-shaped body having a pair of ax-shaped lateral plates each comprising a beveled top end, a hook on an inner side beneath the beveled top end, a sixth aligned thru hole centrally formed in an upper portion and being engageable with the first aligned oblong hole and secured by a second axial pin through the first aligned oblong hole, and a second aligned vertical oblong hole centrally formed in a lower portion and being engageable with the third aligned hole and slidably secured by a third axial pin therethrough;

a coil spring having pair of hooks at two ends respectively for hooking the second and third axial pin;

whereby the slide is vertically slidable in the hollow body of the joint and returnable by the resilience of the coil spring.

2. The joint as recited in claim 1 wherein said third notches prevent the V-shaped spring plate from being inclined relative to said rods of said rail.

3. The joint as recited in claim 1 wherein the reduced ends engage the beveled top end of said slide and are able to be hooked by the hook of said slide.

4. The joint as recited in claim 1 wherein said second axial pin is slidable in the first vertical oblong hole of said hollow body.

5. The joint as recited in claim 1 wherein said third axial pin is slidable in the second vertical oblong hole of said slide.

6. The joint as recited in claim 1 wherein the beveled top end can be slid out of the openings of said hollow body.

7. The joint as recited in claim 1 wherein said projections are disengageable with the second aligned thru hole upon an upward sliding of said slide.

8. The joint as recited in claim 1 wherein the two rods of said rail are rotatable upon the disengagement of the projections with the second aligned thru hole.

* * * * *